US006554409B2

(12) United States Patent
Ishii

(10) Patent No.: US 6,554,409 B2
(45) Date of Patent: Apr. 29, 2003

(54) INK-JET RECORDING HEAD

(75) Inventor: Takayuki Ishii, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/725,870

(22) Filed: Nov. 30, 2000

(65) Prior Publication Data

US 2001/0002839 A1 Jun. 7, 2001

(30) Foreign Application Priority Data

Dec. 1, 1999 (JP) ..... 11-342034
Nov. 17, 2000 (JP) ..... 2000-351734

(51) Int. Cl.[7] ..... B41J 2/045
(52) U.S. Cl. ..... 347/71
(58) Field of Search ..... 347/71, 70, 68, 347/65

(56) References Cited

U.S. PATENT DOCUMENTS 4,611,219 A 9/1986 Sugitani ..... 346/140 R
4,905,017 A 2/1990 Sugitani ..... 346/1.1
5,610,645 A 3/1997 Moore et al.
5,867,189 A * 2/1999 Whitlow et al. ..... 347/47
5,907,338 A * 5/1999 Burr et al. ..... 347/43

FOREIGN PATENT DOCUMENTS

EP 0 622 210 11/1994
EP 0 726 151 8/1996
JP 4-10948 1/1992

OTHER PUBLICATIONS

European Search Report dated Mar. 20, 2001.

* cited by examiner

*Primary Examiner*—Thinh Nguyen
(74) *Attorney, Agent, or Firm*—Sughrue Mion, PLLC

(57) ABSTRACT

An ink-jet recording head can be formed in a small size to use an increased number of kinds of inks. The ink-jet recording head has an actuator unit (1) including a pressure chamber forming plate (10) provided with a plurality of pressure chambers (2), and a plurality of pressure generators (6) that produce pressure in the plurality of pressure chambers (2), respectively, to jet ink; and a passage unit (5) stacked on the actuator unit (1) and including two or more ink storage chamber forming plates (16A, 16B and 16C), each provided with at least one ink storage chamber (4A, 4B, 4C). The pressure chambers are grouped into two or more pressure chamber groups that correspond to two or more kinds of inks, respectively. The ink storage chambers (4A, 4B, 4C) store inks to be supplied to the pressure chamber groups (2A, 2B, 2C), respectively.

16 Claims, 10 Drawing Sheets

INK-JET RECORDING HEAD

BACKGROUND OF THE INVENTION

1. Field of the Invention

The present invention relates to an ink-jet recording head provided with pressure generators that produce pressure in pressure chambers, respectively to jet ink.

2. Description of the Related Art

A conventional ink-jet recording head (hereinafter, referred to simply as "recording head") provided with piezoelectric vibrators of a flexural vibration mode will be described by way of example with reference to FIGS. 7 to 9. As shown in FIGS. 7 to 9, the recording head has actuator units 100 and a passage unit 105 superposed on the actuator units 100.

Each actuator unit 100 includes a pressure chamber forming plate 10 provided with a plurality pressure chambers 2, a vibrating plate 11 superposed on the pressure chamber plate 10 so as to cover the open upper ends of the pressure chambers 2, and a plurality of piezoelectric vibrators 6 placed at positions respectively corresponding to the plurality of pressure chambers 2 on the vibrating plate 11.

The passage unit 105 includes a nozzle plate 17 provided with nozzle apertures 3, a storage chamber forming plate 16 provided with ink storage chambers 4, and an ink supply port forming plate 18 superposed on the storage chamber forming plate 16. The passage unit 105 is attached to the lower surface of the actuator units 100. Each pressure chamber 2 is an elongated slot having one end communicating with the ink storage chamber 4 and the other end communicating the nozzle aperture 3.

The ink storage chamber forming plate 16 is provided with connecting holes 9 communicating with the nozzle apertures 3. The ink supply port forming plate 18 is provided with ink supply ports 15 through which the ink is supplied from the ink storage chambers 4 into the pressure chambers 2, and connecting holes 8 connecting the pressure chambers 2 and the connecting holes 9 communicating with the nozzle apertures 3, respectively. The ink supply port forming plate 18 is provided also with ink supply ports 24 through which the ink is supplied from an ink cartridge, not shown, into the ink storage chambers 4.

The recording head shown in FIG. 7 is a six-color recording head that prints in six color inks. The recording head is provided with the three actuator units 100. Each actuator unit 100 is provided with two rows of the pressure chambers 2 arranged in a feed direction in which a recording sheet is fed. The three actuator units 100 are arranged in a scanning direction along the width of the recording sheet in which the recording head is moved for printing. The six ink storage chambers 4 of the passage unit 105 are arranged along the width of the recording sheet so as to correspond to the rows of the pressure chambers 2, respectively. The color inks of the different colors are jetted through the nozzle apertures 3 of the six rows respectively corresponding to the rows of the pressure chambers 2.

Lower electrodes 19 are formed on the upper surfaces of portions of the vibrating plate 11 of each actuator unit 100 corresponding to the pressure chambers 2, respectively. Flat piezoelectric vibrators 6 are formed on the upper surfaces of the lower electrodes 19 and an upper electrode 20 is formed on the upper surfaces of the piezoelectric vibrators 6, respectively.

As shown in FIG. 8, terminals 21 are formed on the opposite ends of the upper surface of each actuator unit 100 so as to be connected electrically to the upper electrodes 20 on the piezoelectric electric vibrators 6, respectively. A flexible wiring board 22 is placed on the terminals 21. Driving signals are applied through the terminals 21 and the upper electrodes 20 to the piezoelectric vibrators 6.

The ink drops are jetted through the nozzle apertures 3 by producing pressure in the pressure chambers 2 by the flexural vibration of the piezoelectric vibrators 6. As shown in FIG. 10, the piezoelectric vibrator 6 contracts laterally when a driving signal is applied to the piezoelectric vibrator 6. A lower portion of the piezoelectric vibrator 6 fixed to the vibrating plate 11 does not contract and only an upper portion of the same contracts. Consequently, a portion of the vibrating plate 11 corresponding to the piezoelectric vibrator 6 and the piezoelectric vibrator 6 bend in a downward convex shape to compress the pressure chamber 2, so that the pressure in the pressure chamber 2 is increased and the ink contained in the pressure chamber 2 is jetted through the nozzle aperture 3 in the form of an ink drop 23. The ink drop 23 forms a dot on the recording sheet for printing. When the driving signal is removed from the piezoelectric vibrator 6 to allow the piezoelectric vibrator 6 to return to its original shape, the ink is supplied from the ink storage chamber 4 through the ink supply port 15 into the pressure chamber 2.

In the conventional recording head, the six ink storage chambers 4 are formed in the single storage chamber forming plate 16 to supply the inks from the six ink storage chambers 4 to the six rows of the pressure chambers 2 and the inks are jetted through the six rows of the nozzle apertures 3. Since the six ink storage chambers 4 are arranged laterally in a plane, the recording head necessarily has a large lateral size.

Studies have been made in recent years to use more than six color inks for the further improvement of print quality. The use of more than six color inks inevitably entails increase in the size of the recording head, affects adversely to accuracy and hence has not been realized.

In another known recording head, one row of pressure chambers 2 is divided into a plurality of sections, and a plurality of ink storage chambers 4 are formed for the sections of the row of the pressure chambers 2, respectively, to use a plurality of color inks. This known recording head, similarly to the foregoing conventional recording head, needs one storage chamber forming plate provided with many ink storage chambers 4 and there is a limit to the reduction of the size of the recording head.

SUMMARY OF THE INVENTION

The present invention has been made in view of the foregoing problems and it is therefore an object of the present invention to provide an ink-jet recording head of a small size and capable of using an increased number of kinds of inks without increasing the size.

According to the present invention, an ink-jet recording head has: an actuator unit including a pressure chamber forming plate provided with a plurality of pressure chambers, and a plurality of pressure generators that produce pressure in the pressure chambers, respectively, to jet ink, the pressure chambers being grouped into two or more pressure chamber groups that correspond to two or more kinds of inks, respectively; and a passage unit stacked on the actuator unit and including two or more ink storage chamber forming plates that are stacked on each other, each of the two or more ink storage chamber forming plates being provided with at least one ink storage chamber, the ink storage chambers storing inks to be supplied to the pressure chamber groups, respectively.

Preferably, the pressure chambers are arranged in a row. The passage unit may have two or more ink inlet openings through which inks are supplied into the two or more ink storage chambers, respectively. The two or more ink inlet openings may be arranged in a direction perpendicular to a direction in which the pressure chambers are arranged.

Preferably, the ink-jet recording head further has at least one partition plate interposed between the storage chamber forming plates. The two or more ink storage chambers may overlap at least partly each other with respect to a direction in which the two or more storage chamber forming plates are stacked. Portions of the two or more ink storage chambers overlapping each other may be isolated from each other by the partition plate.

Preferably, the partition plate is a flexible plate capable of being distorted by pressure applied to the pressure chamber.

Preferably, the ink storage chambers of the passage unit have profiles that are formed of smooth curves.

Preferably, the pressure chambers that receive ink from the same ink storage chamber are arranged adjacently.

Preferably, the pressure generators are piezoelectric vibrators of a flexural vibration mode.

Preferably, the pressure generator applies pressure to the pressure chamber in a direction in which ink is jetted.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

FIGS. 1 to 4 show an ink-jet recording head (hereinafter referred to simply as "recording head") in a first embodiment according to the present invention including an actuator unit 1 and a passage unit 5. The actuator unit 1 is stacked on the passage unit 5.

Figure 10:
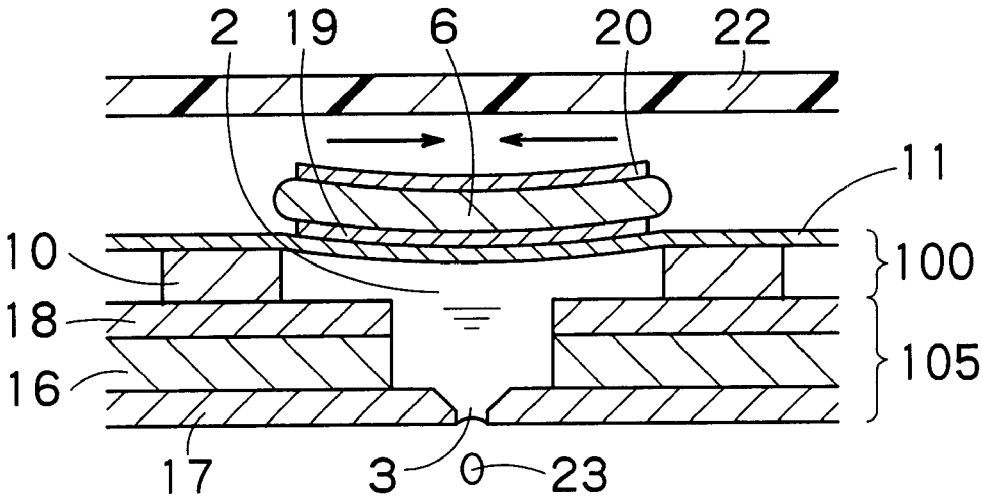
FIG. 10 is a typical view of assistance in explaining the operation of the conventional ink-jet recording head shown in FIG. 7.

The actuator unit 1 includes a pressure chamber forming plate 10 provided with a plurality of pressure chambers 2, a vibrating plate 11 placed in close contact with the upper surface of the pressure chamber forming plate 10 so as to cover the open upper ends of the pressure chambers 2, and a plurality of piezoelectric vibrators 6 formed on portions of the vibrating plate 11 corresponding to the plurality of pressure chambers 2, respectively. The piezoelectric vibrators 6 are of a flexural vibration mode. In the actuator unit 1, the piezoelectric vibrators 6 perform a flexural vibration to produce pressure in the corresponding pressure chambers 2 to jet ink drops through nozzle apertures 3 (see FIG. 10).

Figure 2:
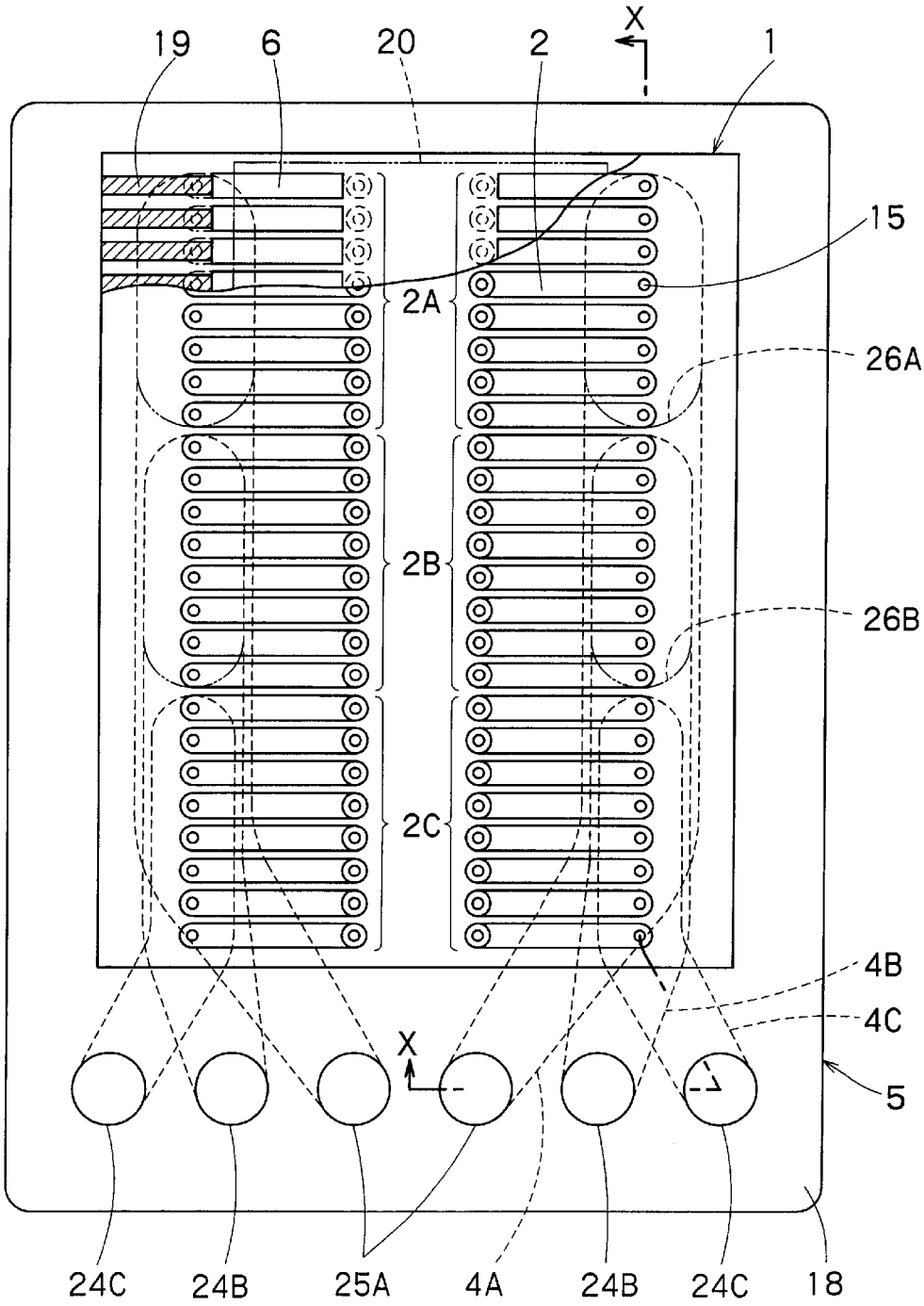
FIG. 2 is plan view of assistance in explaining the positional relation between pressure chambers and ink storage chambers in the ink-jet recording head in the first embodiment.

As shown in FIG. 2, each row of the pressure chambers 2 is grouped into three pressure chamber groups 2A, 2B and 2C. The pressure chambers 2 of the actuator unit 1 are elongated slots. One end of each of the pressure chambers 2 of a first group 2A, one end of each of the pressure chambers 2 of a second group 2B and one end of each of the pressure chambers 2 of a third group 2C communicate with ink storage chambers 4A, 4B and 4C, respectively, and the other ends of the pressure chambers 2 communicates with the nozzle apertures 3. The pressure chambers 2 are arranged in two rows in a recording sheet feed direction.

Lower electrodes 19 are formed on portions of the upper surface of the vibrating plate 11 of the actuator unit 1 overlying the pressure chambers 2, respectively. The flat piezoelectric vibrators 6 are formed on the upper surfaces of the lower electrodes 19, respectively, and an upper electrode 20 is formed on the upper surfaces of the piezoelectric vibrators 6.

Figure 1:
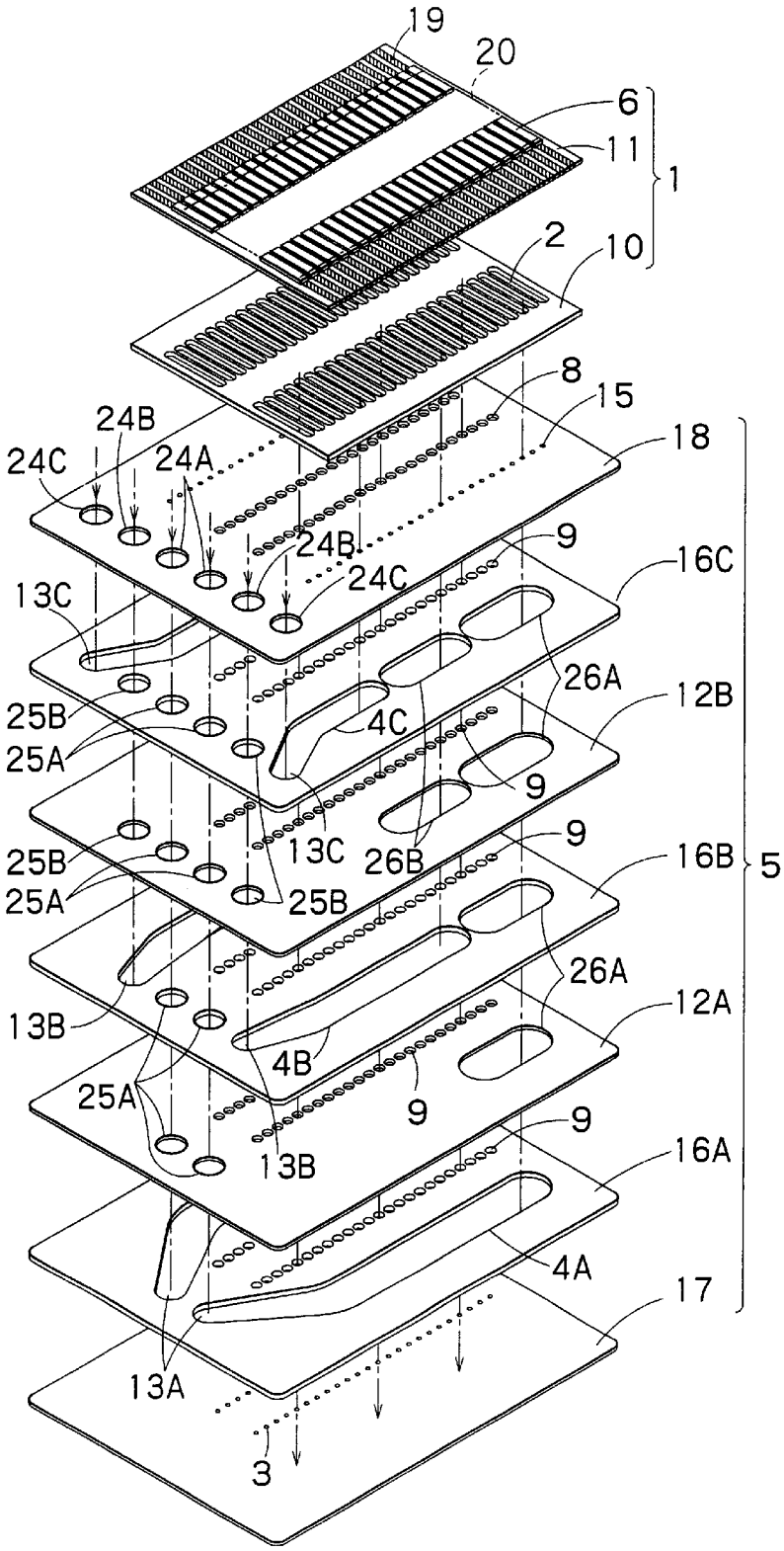
FIG. 1 is an exploded perspective view of an ink-jet recording head in a first embodiment according to the present invention.
Figure 3:
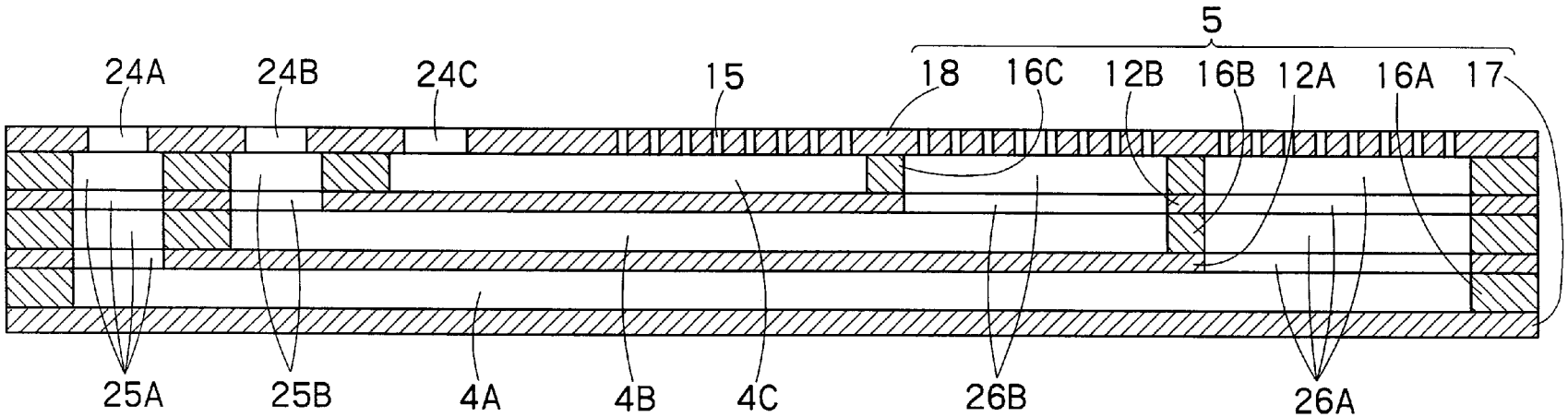
FIG. 3 is a sectional view taken on line X—X in FIG. 2.
Figure 4:
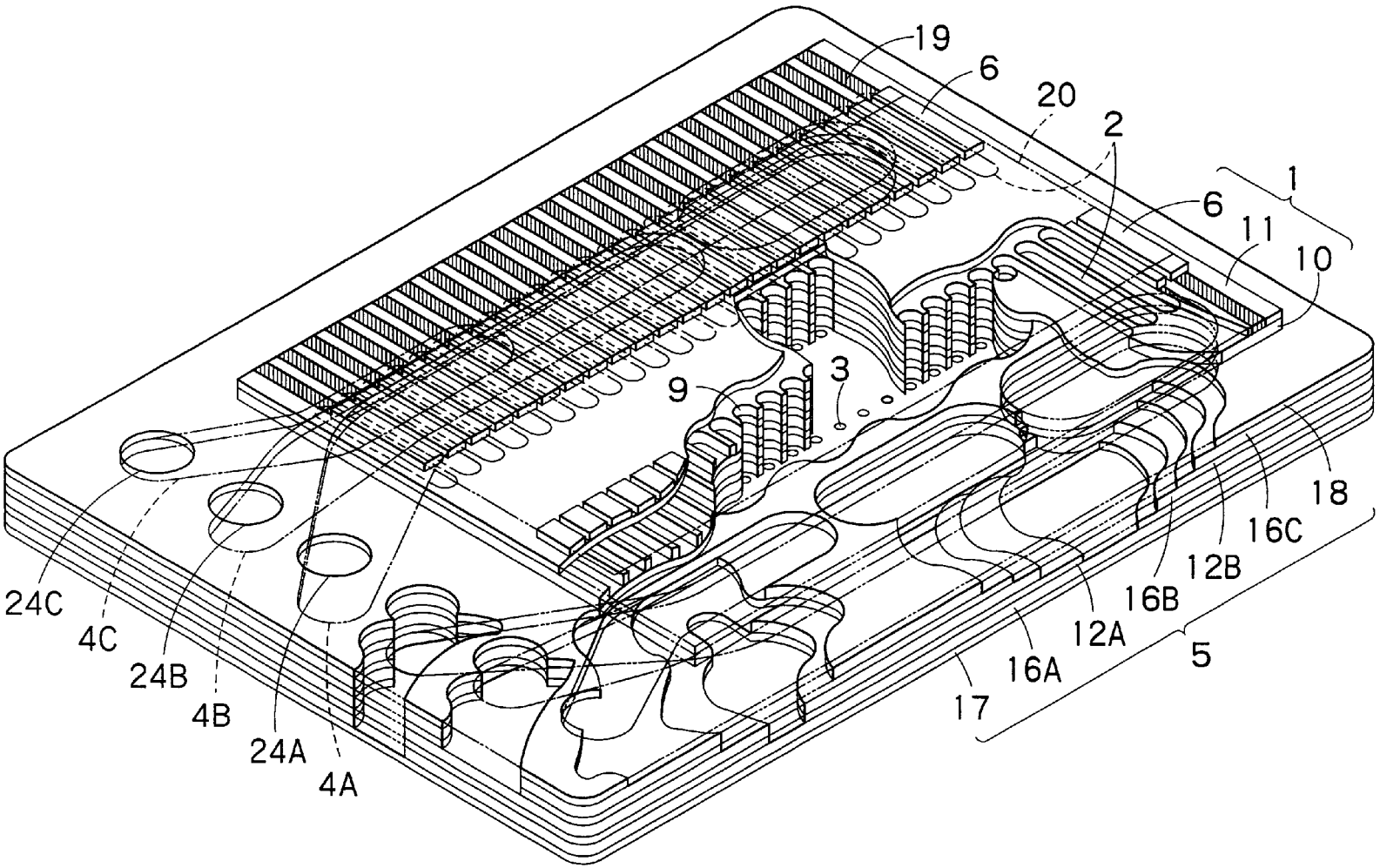
FIG. 4 is a partly cutaway perspective view of the ink-jet recording head in the first embodiment.

The passage unit 5 includes three storage chamber forming plates 16A, 16B and 16C provided with the ink storage chambers 4A, 4B and 4C, respectively, two partition plates 12A and 12B inserted between the storage chamber forming plates 16A and 16B and between the storage chamber forming plates 16B and 16C, respectively, so as to cover the ink storage chambers 4A, 4B and 4C, a nozzle plate 17 provided with the nozzle apertures 3 and attached to the lower surface of the storage chamber forming plate 16A, and a ink supply port forming plate 18 placed on the upper surface of the storage chamber forming plate 16C. The three storage chamber forming plates 16A, 16B and 16C, the two partition plates 12A and 12B, the nozzle plate 17 and the ink supply port forming plate 18 are superposed one on top of one another as shown in FIGS. 1 and 3.

The ink supply port forming plate 18 is provided with ink supply ports 15 through which inks are supplied from the ink storage chambers 4A, 4B and 4C to the associated pressure chambers 2, and connecting holes 8 by means of which the pressure chambers 2 communicate with the nozzle apertures 3, respectively.

The passage unit 5 has six ink inlet openings 24A, 24B and 24C through which inks are supplied from ink cartridges, not shown, into the ink storage chambers 4A, 4B and 4C. The six ink inlet openings 24A, 24B and 24C are arranged in a direction perpendicular to a direction in which the rows of the pressure chambers 2 are extended. In other words, the six ink inlet openings 24A, 24B and 24C are arranged in a scanning direction in which the recording head is moved for printing. The nozzle plate 17 is provided with the plurality of nozzle apertures 3 arranged in two lines corresponding to the two rows of the pressure chambers 2 of the actuator unit 1.

The first storage chamber forming plate 16A is provided with connecting holes 9 connected to the nozzle apertures 3, respectively, and the first ink storage chambers 4A. Each first ink storage chamber 4A has an ink inlet portion 13A at one end thereof. The ink inlet portion 13A communicates with the ink inlet opening 24A by means of connecting holes 25A formed in the first partition plate 12A, the second partition plate 12B, the second storage chamber forming plate 16B and the third storage chamber forming plate 16C. The other end portion of each first ink storage chamber 4A communicates with the ink supply ports 15 and the pressure chambers 2 by means of connecting holes 26A formed in the first partition plate 12A, the second partition plate 12B, the second storage chamber forming plate 16B and the third storage chamber forming plate 16C.

The ink introduced into the ink inlet openings 24A by the ink cartridge, not shown, flows through the connecting holes 25A and the ink inlet portions 13A into the first ink storage chambers 4A. The ink stored in the first ink storage chambers 4A flows through the connecting holes 26A and the ink supply ports 15 into the pressure chambers 2.

The first partition plate 12A is placed on the upper surface of the first storage chamber forming plate 16A so as to cover most part of the open upper ends of the first ink storage chambers 4A excluding portions of the same. The first partition plate 12A is provided with the connecting holes 9 connected to the nozzle apertures 3. As mentioned above, the first partition plate 12A is provided with the connecting holes 25A through which the ink inlet portions 13A of the first ink storage chambers 4A are connected to the ink inlet openings 24A, and the connecting holes 26A through which the other ends of the first ink storage chambers 4A are connected to the ink supply ports 15 and the pressure chambers 2.

The second storage chamber forming plate 16B is provided with the connecting holes 9 connected to the nozzle apertures 3, and the second ink storage chambers 4B. Each second ink storage chamber 4B has an ink inlet portion 13B at one end thereof. The ink inlet portion 13A communicates with the ink inlet opening 24B by means of the connecting holes 25A formed in the second partition plate 12B and the third storage chamber forming plate 16C. The other end portion of each second ink storage chamber 4B communicates with the ink supply ports 15 and the pressure chambers 2 by means of connecting holes 26B formed in the second partition plate 12B and the third storage chamber forming plate 16C.

The ink introduced into the ink inlet openings 24B by the ink cartridge, not shown, flows through the connecting holes 25B and the ink inlet portions 13B into the second ink storage chambers 4B. The ink stored in the second ink storage chambers 4B flows through the connecting holes 26B and the ink supply ports 15 into the pressure chambers 2.

As mentioned above, the second storage chamber forming plate 16B is provided with the connecting holes 25A by means of which the ink inlet portions 13A of the first ink storage chambers 4A communicate with the ink inlet openings 24A, and the connecting holes 26A connecting the other end portions of the first ink storage chambers 4A to the ink supply ports 15 and the pressure chambers 2.

The second partition plate 12B is inserted between the second storage chamber forming plate 16B and the third storage chamber forming plate 16C, and covers part of the open upper ends of the second ink storage chambers 4B and the open lower ends of the third ink storage chambers 4C. The second partition plate 12B is provided with the connecting holes communicating with the nozzle apertures 3. As mentioned above, the second partition plate 12B is provided with the connecting holes 25A through which the ink inlet portions 13A of the first ink storage chambers 4A are connected to the ink inlet openings 24A, and the connecting holes 26A through which the other ends of the first ink storage chambers 4A are connected to the ink supply ports 15 and the pressure chambers 2.

The second partition plate 12B is provided with the connecting holes 25B through which the ink inlet portions 13B of the second ink storage chambers 4B communicate with the ink inlet openings 24B, and the connecting holes 26B through which the other end portions of the second ink storage chambers 4B are connected to the ink supply ports 15 and the pressure chambers 2.

The third storage chamber forming plate 16C is provided with the connecting holes 9 connected to the nozzle apertures 3, respectively, and the third ink storage chambers 4C. Each third ink storage chamber 4C has an ink inlet portion 13C at one end thereof. The ink inlet portion 13C communicates with the ink inlet opening 24A. The other end portion of each third ink storage chamber 4C communicates with the ink supply ports 15 and the pressure chambers 2.

The ink introduced into the ink inlet openings 24C by the ink cartridge, not shown, flows through the ink inlet portions 13C into the third ink storage chambers 4C. The ink stored in the third ink storage chambers 4C flows through the ink supply ports 15 into the pressure chambers 2.

As mentioned above, the third storage chamber forming plate 16C is provided with the connecting holes 25A and 25B for connecting the ink inlet portions 13A of the first ink storage chambers 4A and the ink inlet portions 13B of the second ink storage chambers 4B to the ink inlet openings 24A and 24B, respectively. The third storage chamber forming plate 16C is provided further with the connecting holes 26A and 26B for connecting the other end portions of the first ink storage chambers 4A and the other end portions of the second ink storage chambers 4B to the ink supply ports 15 and the pressure chambers 2.

The first storage chamber forming plate 16A, the second storage chamber forming plate 16B and the third storage chamber forming plate 16C, the first partition plate 12A, the second partition plate 12B, the ink supply port forming plate 18 and the nozzle plate 17 are stacked in layers to form the passage unit 5. The first ink storage chambers 4A, the second ink storage chambers 4B and the third ink storage chambers 4C overlap each other with respect to a direction in which the first storage chamber forming plate 16A, the second storage chamber forming plate 16B and the third storage chamber forming plate 16C are stacked.

The first partition plate 12A inserted between the first storage chamber forming plate 16A and the second storage chamber forming plate 16B, and the second partition plate 12B inserted between the second storage chamber forming plate 16B and the third storage chamber forming plate 16C are flexible plates capable of being distorted by pressure applied to the pressure chambers 2. Since the partition plates 12A and 12B are flexible, portions of the partition plates 12A and 12B corresponding to the portions of the ink storage chambers 4A, 4B and 4C serve as dampers to suppress crosstalk between the pressure chambers 2 when jetting the ink.

As shown in FIG. 2, each row of the pressure chambers 2 is divided into a first section (a first group) 2A of the successive pressure chambers 2 communicating with the first ink storage chamber 4A, a second section (a second group) 2B of the successive pressure chambers 2 communicating with the second ink storage chamber 4B and a third section (a third group) 2C of the successive pressure chambers 2 communicating with the third ink storage chamber 4C. The pressure chambers 2 arranged in two rows are distributed to the six ink storage chambers 4A, 4B and 4C. The recording head is capable of printing with six color inks.

Bubbles cannot easily adhere to walls defining the ink passages including the ink storage chambers 4A, 4B and 4C of the passage unit 5 and hence faulty ink jetting due to the adverse effect of bubbles cannot easily occur because the ink passages have profiles formed of smooth curves.

Since the ink storage chambers 4A, 4B and 4C are formed in the stacked storage chamber forming plates 16A, 16B and 16C, respectively, the recording head can be formed in a small size smaller than that of the conventional recording head in which all the ink storage chambers are formed in a single storage chamber forming plate. Particularly, the recording head can be formed in a very small size by forming the ink storage chambers 4A, 4B and 4C in the storage chamber forming plates 16A, 16B and 16C so that the ink storage chambers 4A, 4B and 4C overlap each other with respect to a direction in which the storage chamber forming plates 16A, 16B and 16C are stacked.

Even if the number of kinds of inks to be used is increased and the number of ink storage chambers is increased accordingly, increase in size of the recording head can be suppressed by forming ink storage chambers so as to overlap each other with respect to a direction in which the storage chamber forming plates 16A, 16B and 16C are stacked.

Since the ink inlet openings 24A, 24B and 24C of the passage unit 5 are arranged in a row, inks supplied by the ink cartridges can be easily introduced into the passage unit 5 and the recording head and the associated structures can be simplified.

Since the pressure chambers 2 on each row are divided into the successive pressure chambers 2 of the three sections 2A, 2B and 2C communicating with the ink storage chambers 4A, 4B and 4C of the storage chamber forming plates 16A, 16B and 16C, the single actuator unit 1 is able to jet a plurality of kinds of color inks.

Since the pressure chamber forming plate 10 in which the pressure chambers 2 are formed, and the storage chamber forming plates 16A, 16B and 16C provided with the ink storage chambers 4A, 4B and 4C are separate members, pressure applied to the pressure chambers 2 by the piezoelectric vibrators 6 cannot easily propagate to the ink storage chambers 4A, 4B and 4C, and hence crosstalk between the pressure chambers 2 can be prevented.

Since the recording head of the present embodiment is of a face injection type that jets ink drops through the nozzle apertures 3 in a direction parallel to a direction in which the piezoelectric vibrators 6 apply pressure to the corresponding pressure chambers 2, the distances between the pressure chambers 2 and the corresponding nozzle apertures 3 are the same. Accordingly, the plurality of nozzle apertures 3 have the same ink jetting characteristic.

Figure 5:
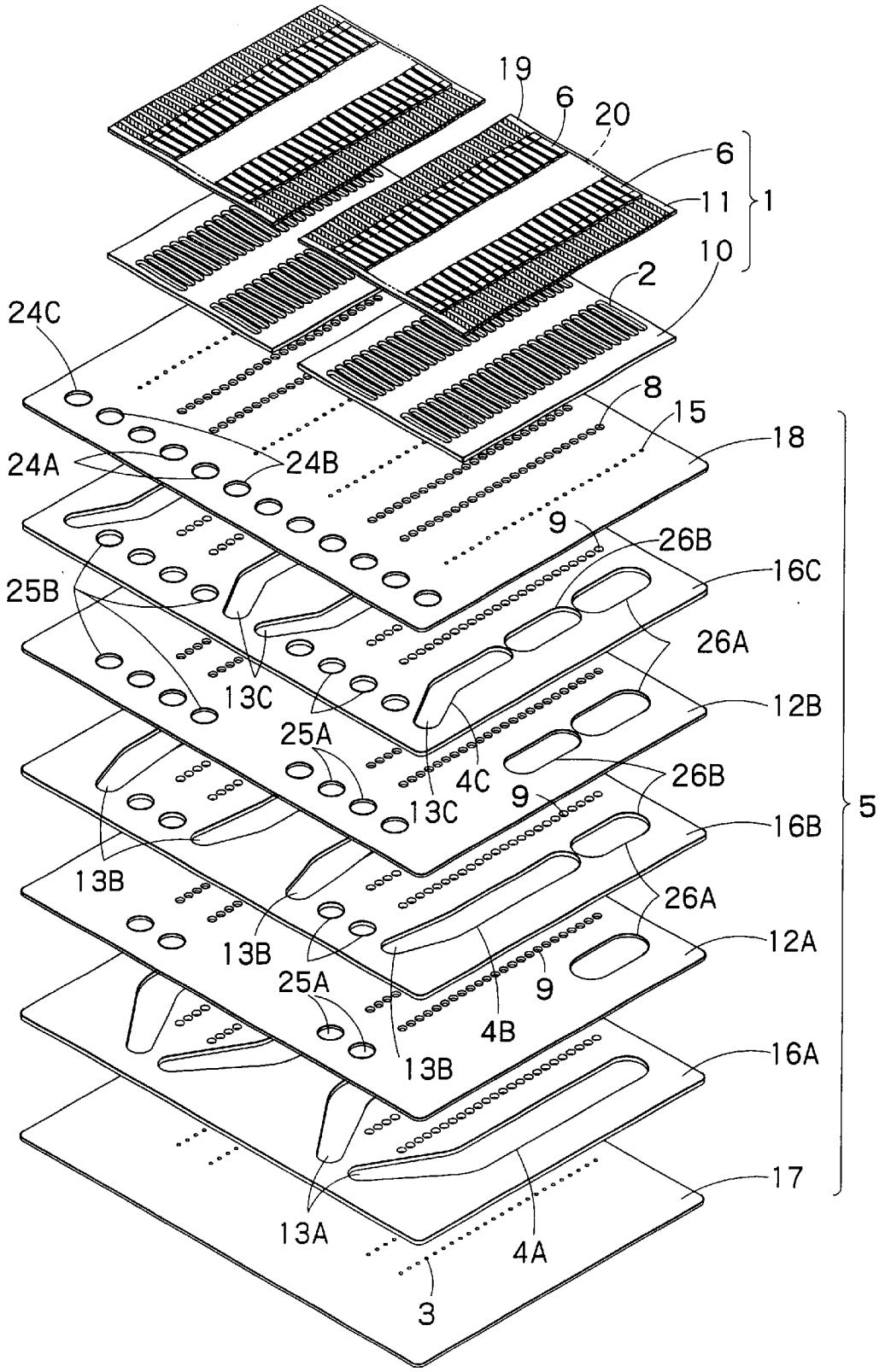
FIG. 5 is an exploded perspective view of an ink-jet recording head in a second embodiment according to the present invention.
Figure 6:
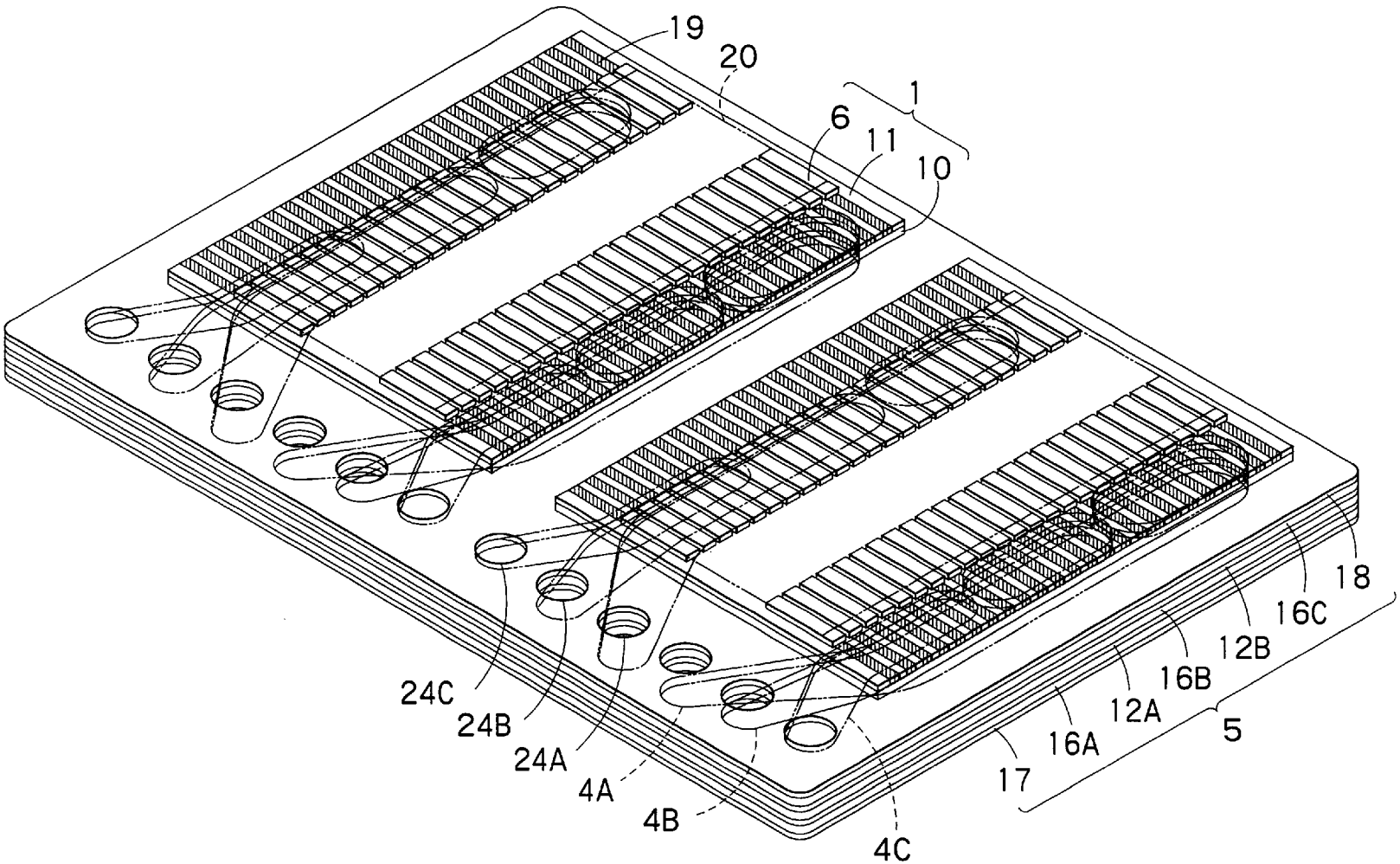
FIG. 6 is a perspective view of the ink-jet recording head shown in FIG. 5.
Figure 7:
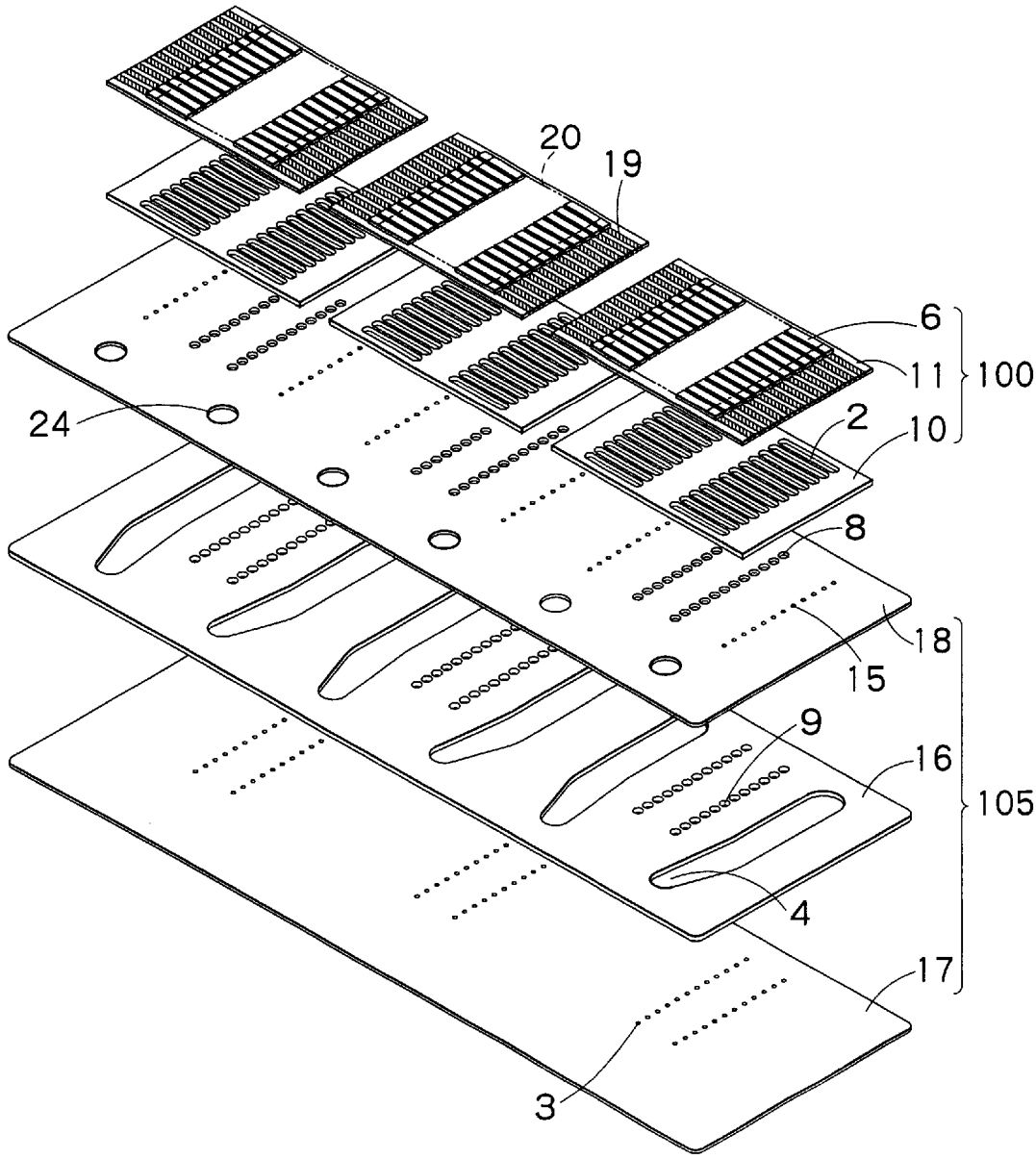
FIG. 7 is an exploded perspective view of a conventional ink-jet recording head.
Figure 8:
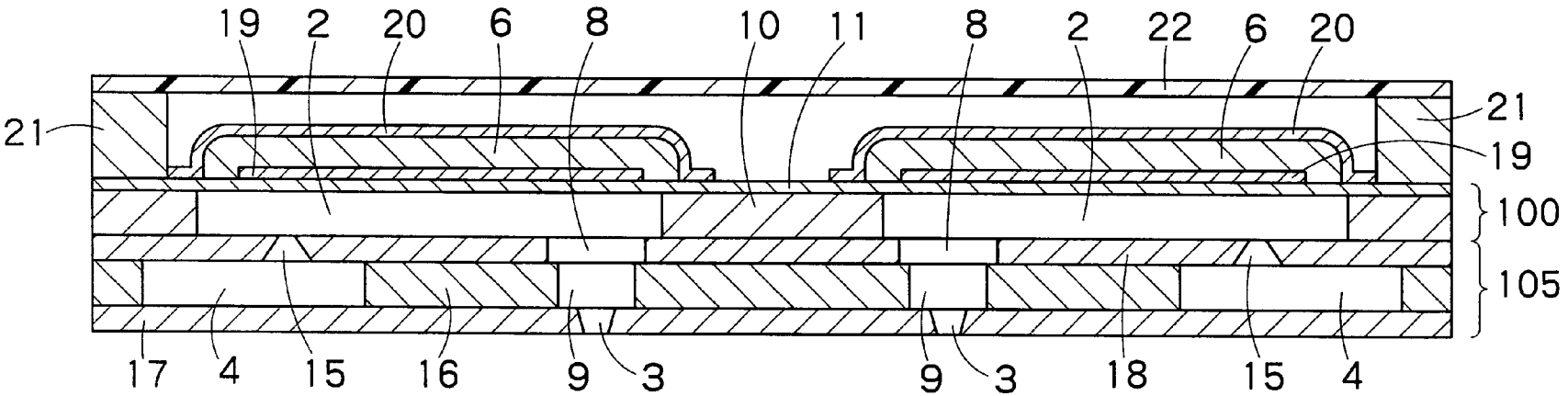
FIG. 8 is a sectional view of the conventional ink-jet recording head shown in FIG. 7.
Figure 9:
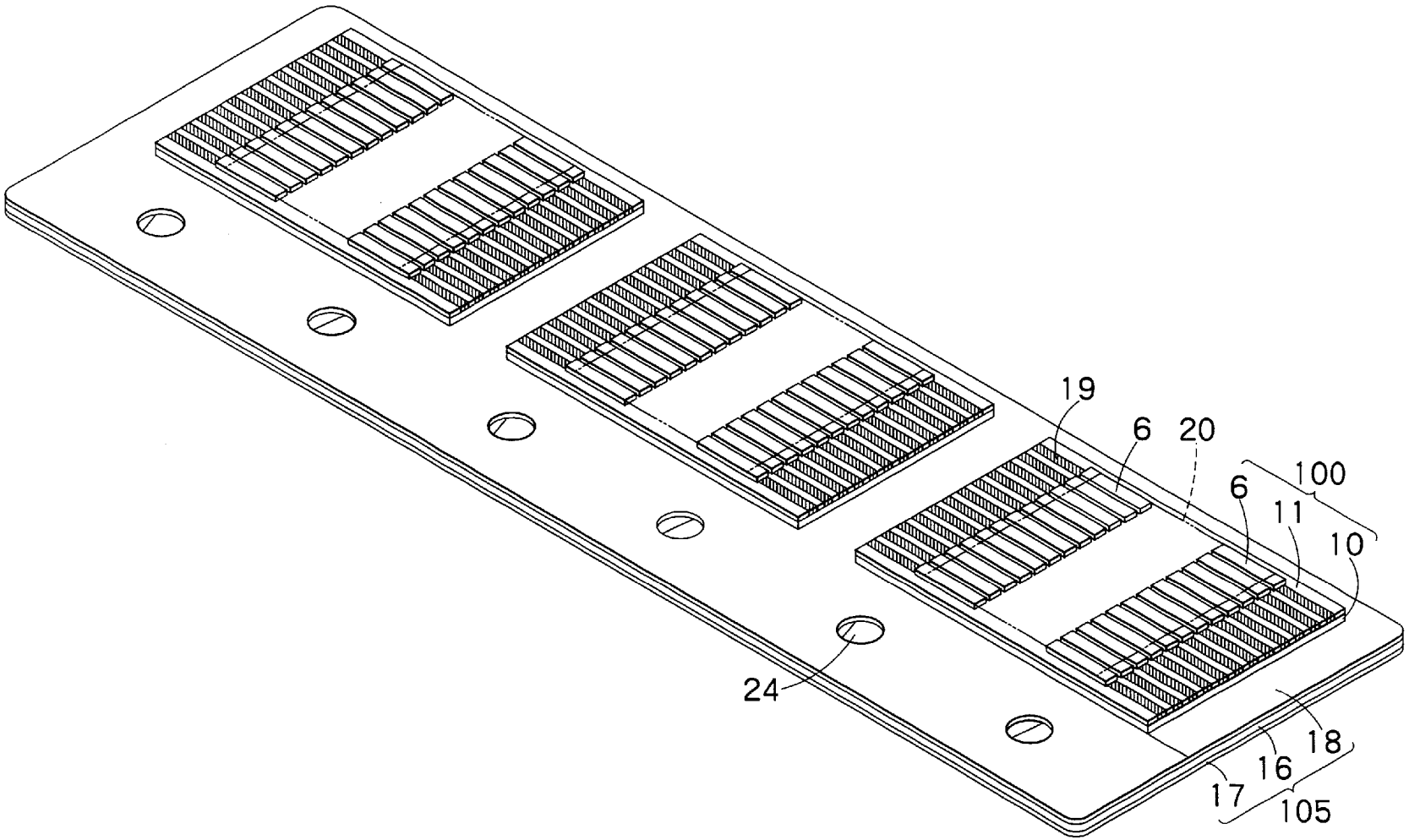
FIG. 9 is a perspective view of the conventional ink-jet recording head shown in FIG. 7.

An ink-jet recording head in a second embodiment according to the present invention will be described with reference to FIGS. 5 and 6. This recording head has two sets of actuator units 1 each provided with pressure chambers 2 arranged in two rows. Each row of the pressure chambers 2 is divided into three sections each of the successive pressure chambers 2 communicating with a first ink storage chamber 4A, a second ink storage chamber 4B and a third ink storage chamber 4C, respectively. Thus, the four rows of the pressure chambers 2 are distributed to the twelve ink storage chambers 4A, 4B and 4C. The recording head is capable of printing with twelve color inks. The recording head in the second embodiment is the same in operation and effect as the recording head in the first embodiment.

Although each row of the pressure chambers 2 are divided into the three sections and the pressure chambers of the three sections are connected to ink storage chambers 4A, 4B and 4C formed in the separate storage chamber forming plates 16A, 16B and 16C in the foregoing embodiments, each row of the pressure chambers 2 may be divided into any optional number of sections.

Although the foregoing embodiments is provided with the three storage chamber forming plates 16A, 16B and 16C and the ink storage chambers 4A, 4B and 4C are arranged in three layers, a recording head according to the present invention may be provided with two storage chamber forming plates to form ink storage chambers in two layers or may be provided with four storage chamber forming plates to form ink storage chambers in four layers.

As apparent from the foregoing description, according to the present invention, the ink-jet recording head is provided with the stacked storage chamber forming plates provided with ink storage chambers. Therefore, the recording head can be formed in a small size smaller than that of the conventional recording head in which all the ink storage chambers are formed in a single storage chamber forming plate.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. An ink-jet recording head comprising:

an actuator unit including a pressure chamber forming plate provided with a plurality of pressure chambers, and a plurality of pressure generators that produce pressure in the pressure chambers, respectively, to jet ink, the pressure chambers being grouped into two or more pressure chamber groups that correspond to two or more kinds of inks, respectively;

a passage unit stacked on the actuator unit and including two or more ink storage chamber forming plates that are stacked on each other, each of the two or more ink storage chamber forming plates being provided with at least one ink storage chamber, the ink storage chambers storing inks to be supplied to the pressure chamber groups, respectively;

at least one partition plate interposed between the storage chamber forming plates, wherein the two or more ink storage chambers overlap at least partly each other with respect to a direction in which the two or more storage chamber forming plates are stacked, and wherein portions of the two or more ink storage chambers overlapping each other are isolated from each other by the partition plate.

2. The ink-jet recording head according to claim 1, wherein the pressure chambers are arranged in a row, wherein the passage unit has two or more ink inlet openings through which inks are supplied into the two or more ink storage chambers, respectively, and wherein the two or more ink inlet openings are arranged in a direction perpendicular to a direction in which the pressure chambers are arranged.

3. The ink-jet recording head according to claim 1, wherein the partition plate is a flexible plate capable of being distorted by pressure applied to the pressure chamber.

4. The ink-jet recording head according to claim 1, wherein the ink storage chambers of the passage unit have profiles that are formed of smooth curves.

5. The ink-jet recording head according to claim 1, wherein the pressure chambers that receive ink from the same ink storage chamber are arranged adjacently.

6. The ink-jet recording head according to claim 1, wherein the pressure generators are piezoelectric vibrators of a flexural vibration mode.

7. The ink-jet recording head according to claim 1, wherein the pressure generator applies pressure to the pressure chamber in a direction in which ink is jetted.

8. An ink-jet recording head comprising:

an actuator unit including a pressure chamber forming plate provided with a plurality of pressure chambers, and a plurality of pressure generators that produce pressure in the pressure chambers, respectively, to jet ink, the pressure chambers being grouped into two or more pressure chamber groups that correspond to two or more kinds of inks, respectively;

a passage unit including two or more ink storage chamber forming plates that are stacked on each other, each of the two or more ink storage chamber forming plates being provided with at least one ink storage chamber, the ink storage chambers storing inks to be supplied to the pressure chamber groups, respectively;

wherein said actuator unit is stacked on an upper surface of said passage unit;

at least one partition plate interposed between the storage chamber forming plates, wherein the two or more ink storage chambers overlap at least partly each other with respect to a direction in which the two or more storage chamber forming plates are stacked, and wherein portions of the two or more ink storage chambers overlapping each other are isolated from each other by the partition plate.

9. The ink-jet recording head according to claim 8, wherein the pressure chambers are arranged in a row, wherein the passage unit has two or more ink inlet openings through which inks are supplied into the two or more ink storage chambers, respectively, and wherein the two or more ink inlet openings are arranged in a direction perpendicular to a direction in which the pressure chambers are arranged.

10. The ink-jet recording head according to claim 8, wherein the partition plate is a flexible plate capable of being distorted by pressure applied to the pressure chamber.

11. The ink-jet recording head according to claim 8, wherein the ink storage chambers of the passage unit have profiles that are formed of smooth curves.

12. The ink-jet recording head according to claim 8, wherein the pressure chambers that receive ink from the same ink storage chamber are arranged adjacently.

13. The ink-jet recording head according to claim 8, wherein the pressure generators are piezoelectric vibrators of a flexural vibration mode.

14. The ink-jet recording head according to claim 8, wherein the pressure generator applies pressure to the pressure chamber in a direction in which ink is jetted.

15. The ink-jet recording head according to claim 1, wherein the passage unit further comprising an ink supply port forming plate disposed on a side of the passage unit facing the actuator unit, the ink supply port forming plate being provided with a plurality of ink supply ports through which inks are supplied from the ink storage chambers to the pressure chambers, respectively, and a plurality of connecting holes by which the pressure chambers communicate with a plurality of nozzle apertures, respectively.

16. The ink-jet recording head according to claim 8, wherein the passage unit further comprising an ink supply port forming plate disposed on a side of the passage unit facing the actuator unit, the ink supply port forming plate being provided with a plurality of ink supply ports through which inks are supplied from the ink storage chambers to the pressure chambers, respectively, and a plurality of connecting holes by which the pressure chambers communicate with a plurality of nozzle apertures, respectively.

* * * * *